United States Patent [19]

Bense et al.

[11] 3,940,078

[45] Feb. 24, 1976

[54] BELT TRAVERSE AND GUIDE MECHANISM

[75] Inventors: William M. Bense, Barrington; Thomas W. Perino, Johnston, both of R.I.

[73] Assignee: Leesona Corporation, Warwick, R.I.

[22] Filed: Aug. 12, 1974

[21] Appl. No.: 496,802

[52] U.S. Cl. ..... 242/43 R; 242/158 B

[51] Int. Cl.[2] ..... B65H 54/30

[58] Field of Search ..... 242/158 B, 43

[56] References Cited

UNITED STATES PATENTS 2,340,436 2/1944 Stone et al. ..... 242/158 B 3,633,836 1/1972 Haag ..... 212/158 B X

*Primary Examiner*—Stanley N. Gilreath

*Attorney, Agent, or Firm*—Burnett W. Norton

[57] ABSTRACT

The instant invention relates to a belt driven traverse for reciprocating a running strand of yarn in a winding machine. Said traverse means comprises a timing type belt travelling in a closed path around two sprockets and which carries and reciprocates a yarn guide longitudinally of a winding package. Means are associated with said yarn guide to prevent rotary motion thereof as it is carried around said closed path.

11 Claims, 12 Drawing Figures

BELT TRAVERSE AND GUIDE MECHANISM

BACKGROUND OF THE INVENTION

During winding of yarn with various winding machines to form a package the yarn is reciprocated across the face of the winding package as said package is rotated. Various types of mechanisms for reciprocating, or traversing, the yarn are employed. One such type is the so-called belt traverse wherein a continuous belt travelling around two centers reciprocates a yarn guide. The prior art belt traversing mechanisms have various disadvantages all of which are overcome by the present invention. For example, the prior art belt traversing mechanisms employ a pair of guides travelling continuously in opposite directions with linear portions of their paths being placed adjacent to the package being wound. This type of structure has the disadvantage that the winding strand of yarn must be transferred from one yarn guide to another. Such transfer requires great precision in manufacture, adjustment and operation of the machine. In addition, in order to intercept the strand, the guides must overhang the belts to such an extent that a sufficient imbalance of the guide assemblies occurs which results in distortion of the belt from its natural flat path which can disturb the interception of the strand at high speeds.

There are also traverse mechanisms which do not incorporate belts such as those of the well known cam type. Such cam type traverses are also disadvantageous in that the reciprocating parts of these traverses are of relatively large mass and are therefore limited in the speed of operation for traversing the yarn. Other cam mechanisms, although of smaller mass, have poor wear resistance since, in order to reduce mass, the rolls which travel in the grooves of a rotating cam have been eliminated and substituted with components which slide in the grooves, thereby causing rapid wear of these components.

It is desirable to wind at speeds higher than now commonly employed because of increased yarn production speeds, but the present mechanisms are limited in this respect. It is therefore highly desirable to provide an apparatus for the high speed traversing and winding of yarn to which the instant invention is directed.

SUMMARY OF THE INVENTION

The instant invention relates to an apparatus for traversing a yarn guide in a continuous looped path to traverse a winding strand of yarn to form a package. The apparatus includes a mechanism for maintaining alignment of the yarn guide in the continuous path comprising caming and aligning mechanisms to prevent the yarn guide from rotating as the yarn guide moves around the looped path.

OBJECTS OF THE INVENTION

A principal object of the present invention is to provide a yarn traversing apparatus which includes a yarn guide movable in a continuous looped path and which is adapted for the high speed winding of yarn.

It is a further object of the present invention to provide an apparatus as aforesaid in which the yarn traversing guide is light in weight and is capable of the high speed winding of yarn.

Further objects and advantages of the present invention will become apparent hereinafter.

DESCRIPTION OF THE PREFERRED EMBODIMENTS

Figure 1:
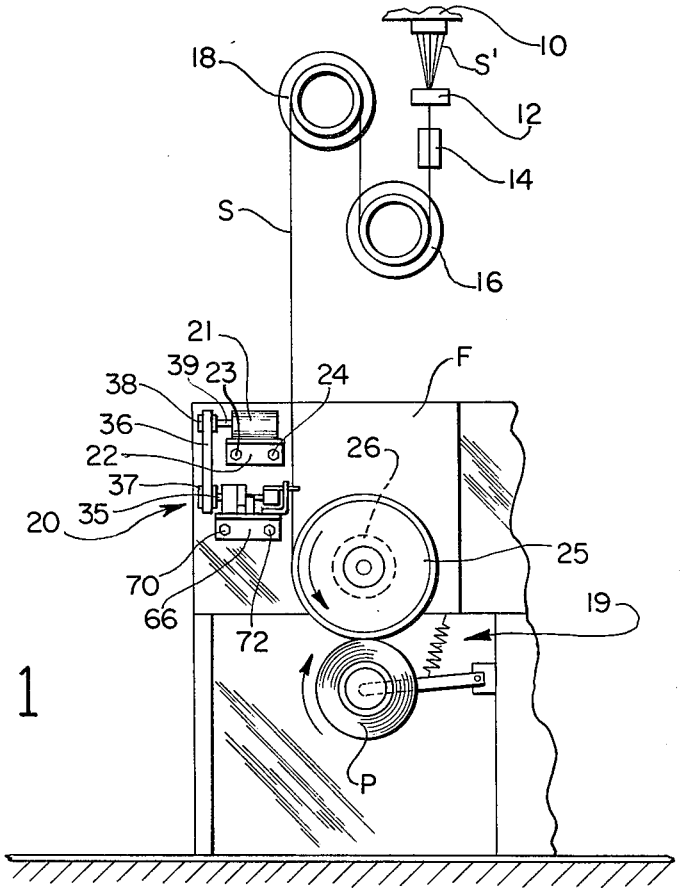
FIG. 1 is a side elevational view of the present invention shown in association with yarn delivery and takeup mechanisms.

FIG. 1 shows the instant invention winding a yarn package P and with associated mechanisms of a take-up or winding machine. As is seen individual filaments S′ may emanate from an extruder 10 which then pass through a yarn guide 12 to form a multifilament yarn S. The yarn or strand S passes over solution roll 14, rolls 16 and 18 and then is wound up on a package P by means of a take-up or winding mechanism indicated generally at 19.

The belt traverse and yarn guide 20 of the present invention assures that the yarn S is presented to the package P in a manner to produce an acceptable package. The yarn guide and belt traverse 20 are driven by a programmed variable speed motor 21 to cause ribbon breaking with the motor 21 being connected with the motor 21, and bolts 23 and 24. The strand S passes from the guide and traverse 20 to the associated roller bail 25 which lays the strand upon the winding package P. The roller bail is connected to and is rotated by a motor 26 and the package P is urged into contact with and is driven by the roller bail 25 in a manner well known in the art.

The instant invention will now be described in detail with reference initially to FIG. 2. A timing belt 30 having lugs 31 is positioned about sprockets 32 and 33 carried by shafts 34 and 35 respectively. As shown in FIG. 1 the shaft 35 is drivingly interconnected with the motor 21 by means of a belt 36 passing about a pulley 37, carried on the end of the shaft 35, and another pulley 38 which is connected with the motor shaft 39. Referring again to FIG. 2 the belt 30 defines a path having parallel straight-away portions A and B and reversal portions C and D, as shown. The sprockets 32 and 33 are of relatively small diameter which minimizes the length of each end reversal portion C and D wherein the deceleration and acceleration of the linear movement of the reciprocating guide occurs. For example, for an approximately 10 inch long traverse it is preferred that the diameter of said sprockets 32 and 33 be between 5/16 inch to ½ inch. This gives a rapid reversal of the guide and gives the desirable "knuckle"

formation essential to a satisfactory self-supporting package.

Figure 3:
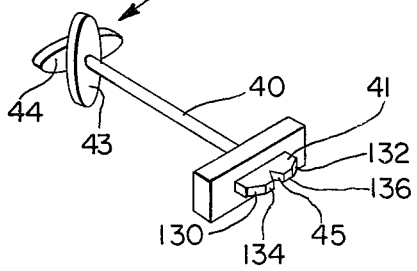
FIG. 3 is a perspective view of the yarn guide and the cam follower unit of the instant invention.
Figure 4:
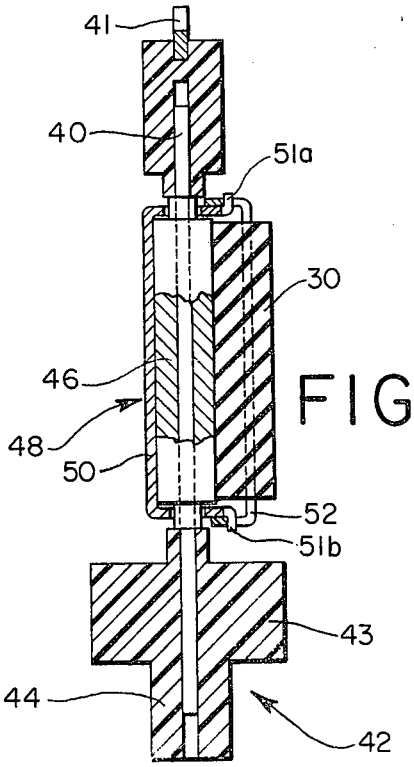
FIG. 4 is an enlarged cross-sectional view of the cam follower unit and yarn guide assembly of the present invention.

The yarn guide assembly, FIGS. 3 and 4, comprises a shaft 40 which has a self threading yarn guide 41 fixed to one end thereof and a cam follower unit 42 fixed to the other end thereof. Cam follower unit 42 comprises vertical cam follower 43 and horizontal cam follower 44, one behind the other to form a cross-like structure. Vertical cam follower 43 is aligned with the axis of the slot 45 in yarn guide 41. The yarn guide assembly is pivotally mounted on the outer surface of timing belt 30 by means of a sleeve bearing 46, in which the shaft 40 is journaled, and a clip 48 which secures said bearing 46 to belt 30. Clip 48 is a two part assembly comprising a housing portion 50 which encloses and holds said bearing against movement between itself and the outer surface of the belt 30. Housing portion 50 has depending fingers 51*a* and 51*b* which engage clip retainer portion 52 positioned on the opposite side of the belt 30.

Figure 5:
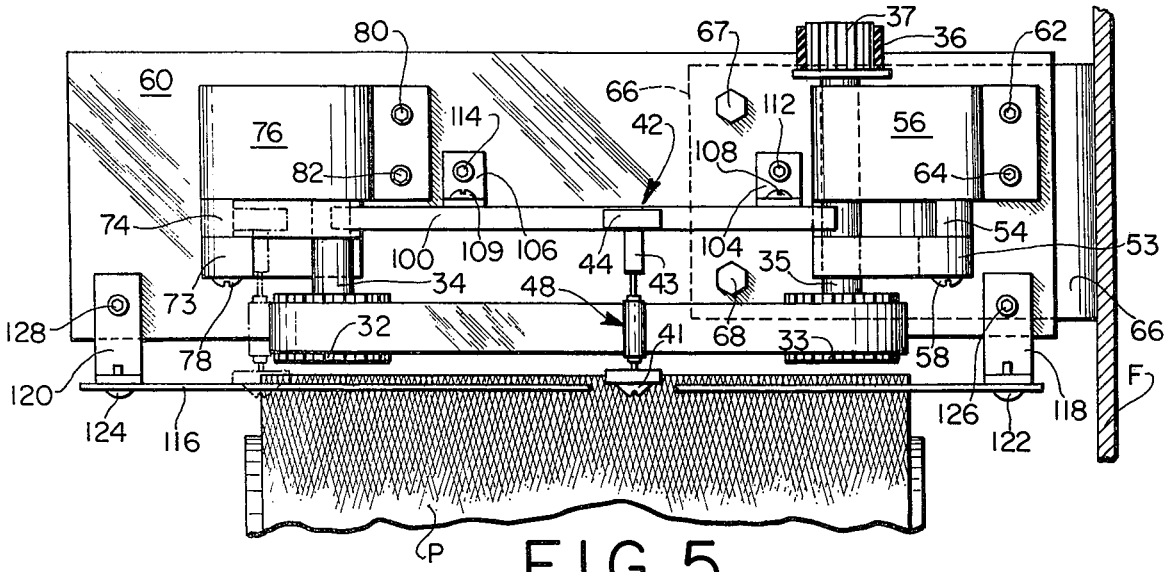
FIG. 5 is a top plan view of the traversing apparatus shown in FIG. 2.

A pair of cams 53 and 54 are positioned adjacent the right hand side of sprocket 33. These cams are secured together and mounted on a bearing block 56 by means of a screw 58. Bearing block 56 is secured to a support plate 60 by means of bolts 62 and 64. Support plate 60 is secured to the frame F by bracket 66 and bolts 67, 68, 70 and 72, as shown in FIGS. 1 and 5. A second pair of cams 73 and 74, which are symetrical to cams 53 and 54, respectively, are positioned adjacent the left hand end of sprocket 32. These cams are secured together and mounted on bearing block 76 by means of screw 78. The bearing block 76 is in turn secured to the support plate 60 by means of bolts 80 and 82 in the same fashion as bearing block 56. Shafts 34 and 35 are journalled in bearing blocks 76 and 56 respectively.

Figure 6:
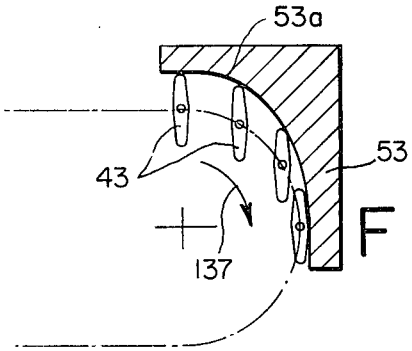
FIGS. 6 and 7 are detailed views of the associated cams and cam followers of the present invention.
Figure 7:
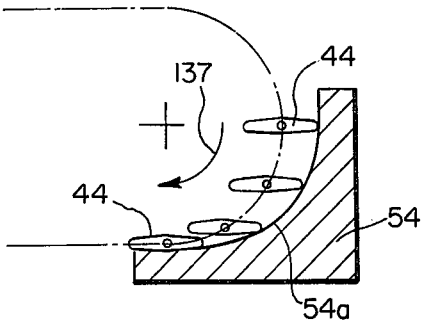

As is shown in FIG. 5 cams 53 and 73 are located in a plane in which cam follower 43 travels and cams 54 and 74 are located in the plane in which cam 44 travels. Referring now to FIGS. 6 and 7 the cam surface 53*a* of cam 53 is a trace of the upper end of vertical cam follower 43 when cam follower unit 42 is held against rotation as the yarn guide assembly is carried in a clockwise direction around sprocket 33, and cam 53 is positioned so that its surface 53*a* is engaged by said upper end to prevent rotation of said cam follower 43; see FIG. 6. Cam surface 54*a* is a trace of the right hand end of horizontal cam follower 44 when cam follower unit 42 is held against rotation as the yarn guide assembly is carried in a clockwise direction around sprocket 33 and cam 54 is positioned so that its surface 54*a* is engaged by said right hand end, as the cam follower unit 42 leaves cam 53, to also prevent rotation of said cam follower. Cam surface 73*a* is a trace of the lower end of vertical cam follower 43 when cam follower unit 42 is held against rotation as the yarn guide assembly is carried in a clockwise direction around sprocket 32, and cam 73 is positioned so that its surface 73*a* is engaged by said lower end to prevent rotation of said cam follower as shaft 40, cam follower unit 42, and yarn guide 41 move around the lower left hand quadrant of sprocket 32. Cam surface 74*a* is a trace of the left hand end of horizontal cam follower 44 when cam follower unit 42 is held against rotation as the yarn guide assembly is carried clockwise around sprocket 32, and cam 74 is positioned so that its surface 74*a* is engaged by said left hand end as the cam follower unit 42 leaves cam 73 as it continues around sprocket 32 to also prevent rotation of said cam follower and the yarn guide 41. It will thus be seen that shaft 40, cam follower unit 42 and yarn guide 41 can travel as a unit as belt 30 travels around 360°, 180° around sprocket 33 and 180° around sprocket 32, and at the same time the guide is prevented from rotating around the axis of shaft 40 by the cams 53, 54, 73 and 74 and cam followers 43 and 44.

Figure 2:
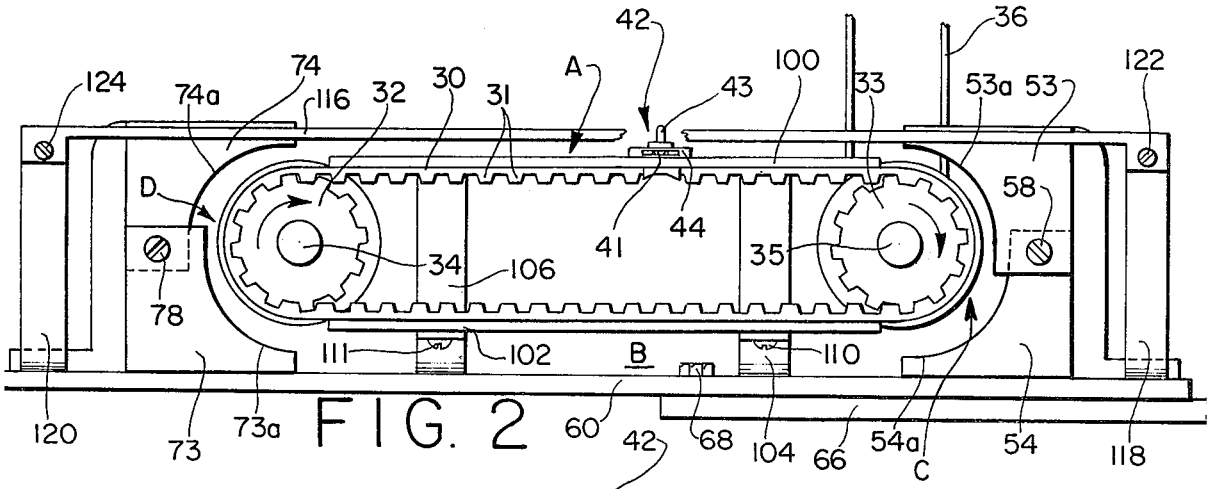
FIG. 2 is a frontelevational view of the traversing apparatus of the present invention showing the continuous looped path of the timing belt and the cams and cam followers of the yarn guide alignment mechanism.

Referring still to FIG. 5, and to FIG. 2, upper and lower guide bars 100 and 102, respectively, are positioned parallel with straight run postions A and B, respectively, of the belt path. The two guide bars are fastened to brackets 104 and 106 by screws 108, 109, 110, and 111. The brackets are in turn connected to the support plate 60 with bolts 112 and 114 respectively, so as to secure the bars parallel to and adjacent the straight-run portions A and B of the belt path. The guide bars are engaged by the cam follower 44 as the guide 41 is traversed along runs A and B to prevent any rotary motion of said guide between sprockets 32 and 33. Although the horizontal cam follower 44 need not constantly touch the guide bars 100 and 102, it is of course important that the bars are so positioned that no significant rotation of guide 41 can take place. As is also seen in FIGS. 2 and 5 a strand guide bar 116 is secured to brackets 118 and 120, by means of rivets 122 and 124 respectively, with the brackets 118 and 120 being in turn secured to the support plate 60 by means of bolts 126 and 128, respectively. The strand guide bar is positioned relative to the looped path and yarn guide 41 to prevent the strand being wound from snagging behind the yarn guide 41 and to position the strand for self threading in said guide.

The configuration of the yarn guide 41 is shown in FIG. 3. The yarn guide 41, which is of a suitable wear resistant material, such as aluminum oxide, includes the slot 45 and opposing ramp portions 130 and 132. These ramp portions are inclined generally towards the slot 45 and terminate in portions 134 and 136 which are perpendicular with the mouth of the slot to provide for the aforesaid self-threading, i.e., the strand is guided over either of these ramps to lodge in the slot 45.

The manner in which the cam followers 43 and 44 operate at the looped path to prevent rotation of shaft 40 and yarn guide 41 is best shown in FIGS. 6 and 7. The same operational mode also occurs at end D of the looped path. FIG. 6 shows the interaction of the vertical cam follower member 43 with the cam 53 and its cam surface 53*a*, while FIG. 7 shows the interaction of horizontal cam follower 44 with the cam 54 and its cam surface 54*a*. More specifically, as the timing belt 30 is driven in a clockwise direction, as shown by the arrow 137, the vertical cam follower member 43 engages cam surface 53*a* of the cam 53. This occurs as the shaft 40, under the turning force of the bearing 46, tends to rotate about its axis in a clockwise direction while passing around the end portion C of the looped path. Such engagement acts to prevent shaft 40 and the yarn guide 41 carried thereby from rotating and thus becoming misaligned. As the cam follower 43 reaches and passes the midpoint of the turn at end portion C it disengages from the cam 53 and at this point the horizontal cam follower 44 engages and begins to travel along cam surface 54*a* of cam 54, which then prevents rotation of shaft 40. Thus the above cooperative action of the vertical and horizontal cam followers serves to maintain a constant positioning of the yarn guide 41 during the passage thereof from straight portion A of the path to straight portion B. As the belt 30 continues to travel cam follower 44 leaves cam surface 54*a* and engages guide bar 102 which prevents any rotation of shaft 40 during the traverse from end C to end D. At the left hand end of guide bar 102 cam follower 44 is disengaged therefrom and the lower end of cam follower 43 then engages cam surface 73*a*. Cam surface 73*a* prevents rotation of shaft 40, as it travels around the lower quadrant of sprocket 32, in the same manner that cam surface 53*a* prevented rotation at end C. As shaft 40 passes the mid-point of sprocket 32 cam follower 43 leaves cam surface 73*a* and cam follower 44 engages cam surface 74*a*. Cam surface 74*a* prevents rotation of shaft 40 in the same manner as cam surface 54*a*. As cam follower 44 leaves cam surface 74*a* it engages guide bar 100 which prevents rotation during the left to right traverse. Naturally, if desired, the guide assembly may be driven in the opposite direction with reverse positioning of the cams 53 and 54, and 73 and 74, respectively.

Figure 8:
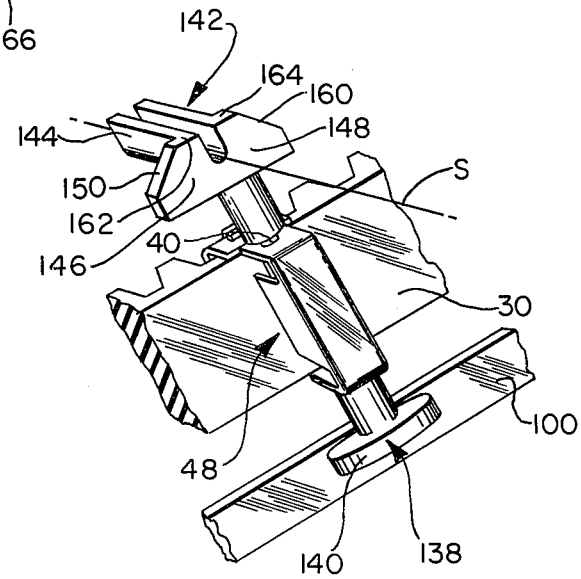
FIG. 8 is a perspective view of an alternative embodiment of the present invention.

FIG. 8 depicts an alternative embodiment of the present invention adapted for use with relatively heavy denier yarn, such as over 1000 denier. In this embodiment, cams about the end portions C and D of the looped path are not employed. Further, in this embodiment, the cam follower unit 138 has a single horizontal cam follower 140 which is fixed about an end of the shaft 40 and which carries on the opposing end thereof a yarn guide 142.

The yarn guide 142, which is of a suitable abrasion resistant material as in the first embodiment, such as aluminum oxide, includes a chute 144 for guiding of a strand of yarn S therein. The yarn guide 142 further includes a pair of ramp members 146 and 148 for self-threading of the strand into the guide chute 144. These guide ramps extend at an acute angle as in the first embodiment to the direction of the vertically extending guide chute 144, and include inclined ramp portions 150 and 160. These inclined portions extend towards the chute 144 and terminate in straightaway portions 162 and 164, respectively, which are generally positioned at right angles to the chute. Thus, when a strand of yarn engages the inclined ramp portions 150 or 160 when threading the strand travels therealong and over the associated straightaway portion 162 or 164 to engage the guide chute 144 for traversing and winding of the strand into a package.

In this embodiment the guide 142 and the cam follower unit 138 are positioned on the timing belt 30 in the same manner as in the first embodiment.

Figure 9:
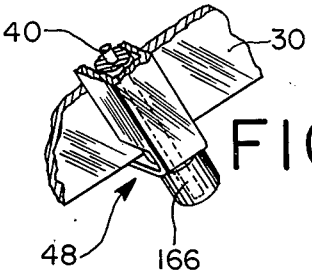
FIG. 9 is a perspective view of a further alternative embodiment of the present invention.

As in the previous embodiment, the guide bar 100 and a second guide bar, not shown, are provided adjacent and parallel to the timing belt 30 in the same manner in order to maintain alignment of the yarn guide 142 in cooperation with horizontal cam follower member 140 during traversing. Since relatively heavy denier yarn is traversed with this embodiment the strand reacting against the walls of the chute 144 counteract the turning forces generated when the yarn guide assembly travels about the ends of the path and thus maintains alignment of the yarn guide 142 during its rotation around the sprockets at the ends of the traverse. Also, since heavier denier yarn is employed with this embodiment the main purpose of the cam follower 140 and the guide bars is to maintain alignment of the yarn guide 142 when self-threading. If self-threading is not employed then the cam follower 140 and the guide bars need not be employed, and a collar 166, FIG. 9, may be substituted for the cam follower 140 to secure the components of the guide assembly to the bearing and thus to the timing belt 30.

Figure 10:
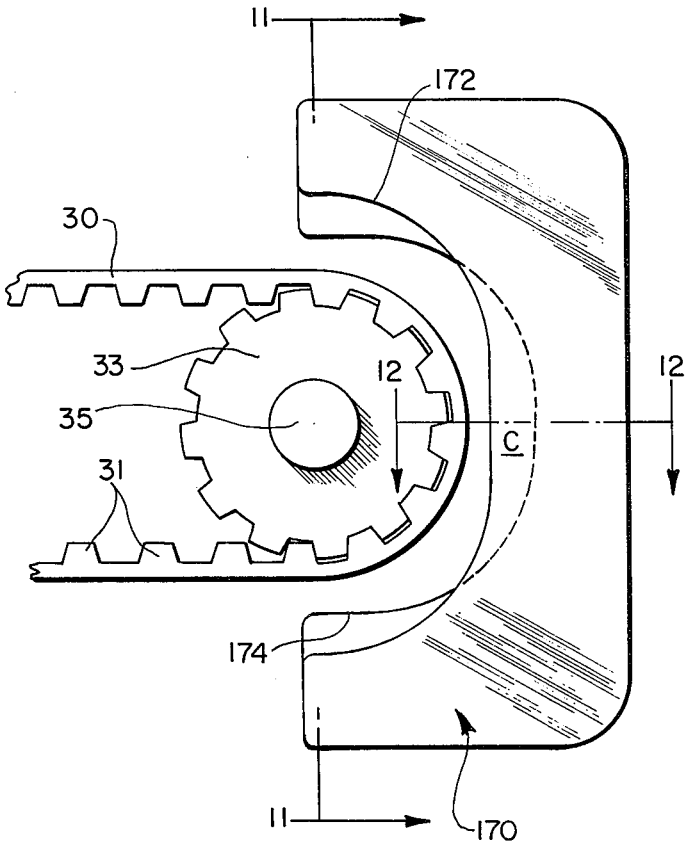
FIGS. 10–12 are views showing an alternative embodiment of the cams of the present invention.
Figure 11:
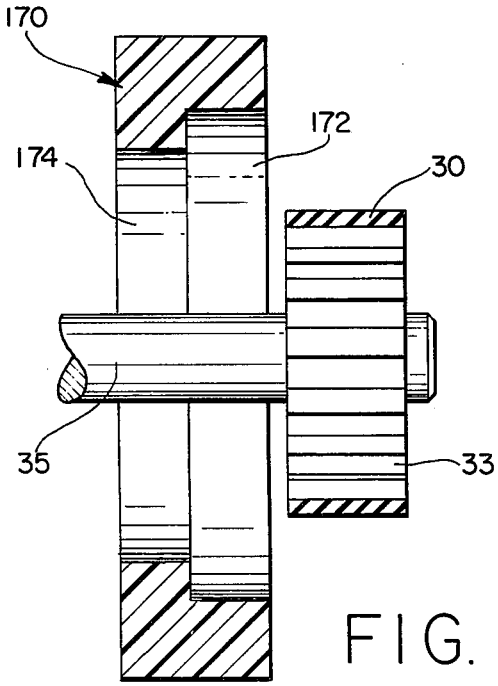
Figure 12:
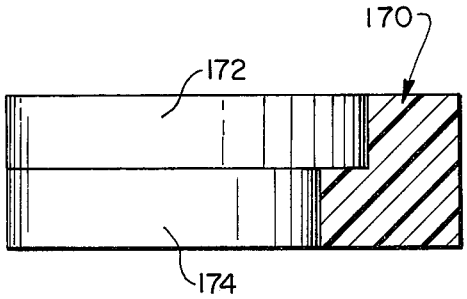

FIGS. 10–12 depict an alternative embodiment of the present invention which is adapted to permit the belt 30 to be rotated in either direction without requiring any readjusting or modification of the traversing mechanism. In this embodiment a pair of 180° cam surfaces are located adjacent each of the end portions of the looped path, rather than a pair of 90° cam surfaces. As shown each of the two cam surfaces at each end of belt 30 are a unitary structure but it will be understood that each cam surface can be on a separate cam and the two cams superimposed. These cams may be conveniently formed by injective molding of a suitable plastic, such as an acetyl resin, if desired. As is shown cam 170 includes a pair of adjacent camming surfaces 172 and 174. The upper half of cam surface 172 is the same as cam surface 53*a*, and is similarly spaced from sprocket 33 and engaged by the upper end of cam follower 43, when belt 30 travels in a clockwise direction, to prevent rotation of shaft 40 during the first 90° of travel around said sprocket 33. The lower half of cam surface 172 is symetrical to the upper half thereof and is engaged by the lower end of cam follower 43, when belt 30 travels in a counter clockwise direction, to prevent rotation of shaft 40 during its movement upwardly around the lower quadrant of sprocket 33. The lower half of cam surface 174 is the same as cam surface 54*a*, is similarly spaced from sprocket 33 and is engaged by the right hand end of cam follower 44, when belt 30 travels in a clockwise direction, to prevent rotation of shaft 40 during the second 90° of travel around said sprocket 33. The upper half of cam surface 174 is symetrical to the lower half thereof and is engaged by the right hand end of cam follower 44, when belt 30 travels in a counterclockwise direction, to prevent rotation of shaft 40 during its movement upwardly around the upper quadrant of sprocket 33. A similar cam, positioned adjacent the other return portion of the looped path, functions in a like manner and by this arrangement the belt 30 may travel in either direction without entailing rearrangement of the cams.

It should be apparent that the present invention may be embodied in other specific forms without departing from the spirit or essential attributes thereof, all of which are intended to be encompassed by the appended claims.

What is claimed is:

1. Apparatus for traversing a strand onto a winding package having a longitudinal face comprising, a continuous looped conveyor having a pair of straight-away portions and opposed return portions to form a looped path, strand guide means carried around said looped path by said conveyor for engaging a strand along the entire length of said looped path and to reciprocate said strand across the longitudinal face of said package, and means to prevent rotation of said strand guide means as said strand guide means moves around said looped path, said means comprising a cam follower means associated with said strand guide means, cam means for contacting said follower means at least during the return portions of the travel of the follower means about said looped path.

2. Apparatus in accordance with claim 1 wherein said cam means is adjacent said return portions of said conveyor.

3. Apparatus in accordance with claim 2 wherein said cam means comprises a first cam surface and a second cam surface adjacent each said return portion, and wherein said cam follower means associated with said strand guide means comprises a first cam follower adapted to engage said first cam surface and a second cam follower adapted to engage said second cam surface.

4. Apparatus in accordance with claim 1 wherein said cam means includes a guide bar operatively positioned and spaced apart from both said strand guide means and said conveyor and further positioned intermediate said opposing return portions of said conveyor, and said cam means adapted to cooperate with said guide bar to maintain generally constant alignment of the strand guide means intermediate said return portions.

5. Apparatus in accordance with claim 4 wherein said cam means is adjacent said return portions of said conveyor.

6. Apparatus in accordance with claim 5 wherein said cam means adjacent said return portions of said conveyor comprises a first cam surface and a second cam surface adjacent each said return portion, and wherein said cam follower means associated with said strand guide means comprises a first cam follower adapted to engage said first cam surface and a second cam follower adapted to engage said second cam surface and to cooperate with said guide bar.

7. Apparatus in accordance with claim 1 wherein said strand guide means includes a central portion having means for fixedly attaching said guide means to said conveyor, a guide portion at one end thereof and extending beyond said conveyor for contacting the strand and said cam follower means extending beyond said conveyor at the other end thereof.

8. Apparatus in accordance with claim 7 wherein said conveyor is a tracked belt.

9. Apparatus in accordance with claim 6 wherein said strand guide means includes a central portion having means for fixedly attaching said guide means to said conveyor, a guide portion at one end thereof and extending beyond said conveyor for contacting the strand and said cam follower means extending beyond said conveyor at the other end thereof.

10. Apparatus in accordance with claim 7 wherein said other end of said strand guide means terminates in said second cam follower.

11. Apparatus in accordance with claim 7 wherein said second cam follower is distal from said central portion of said strand guide means.

* * * * *